US005807215A

United States Patent [19]

Abe et al.

[11] Patent Number: 5,807,215

[45] Date of Patent: Sep. 15, 1998

[54] WEIGHT UNIT WITH ROTATABLE MASS

[75] Inventors: Takeshi Abe; Toshiharu Kumazawa, both of Kamakura, Japan

[73] Assignee: Mitsubishi Precision Co., Ltd., Tokyo, Japan

[21] Appl. No.: 967,417

[22] Filed: Nov. 11, 1997

Related U.S. Application Data

[63] Continuation-in-part of Ser. No. 795,420, Feb. 4, 1997, abandoned.

[30] Foreign Application Priority Data

Feb. 9, 1996 [JP] Japan ..... 8-023915
Nov. 5, 1996 [JP] Japan ..... 8-292837

[51] Int. Cl.[6] ..... A63B 21/22
[52] U.S. Cl. ..... 482/110; 482/139; 79/5 R
[58] Field of Search ..... 482/1, 110, 139; 74/5 R

[56] References Cited

U.S. PATENT DOCUMENTS

D. 351,436 10/1994 Pravitz .
3,617,056 11/1971 Herbold ..... 482/110
3,726,146 4/1973 Mishler .
3,931,742 1/1976 Shirley ..... 74/5.7
4,456,805 6/1984 Jorgensen et al. ..... 185/39
4,640,508 2/1987 Escher ..... 482/110
4,773,640 9/1988 Kolbel et al. ..... 482/108

*Primary Examiner*—Richard J. Apley
*Assistant Examiner*—John Mulcahy
*Attorney, Agent, or Firm*—Paul & Paul

[57] ABSTRACT

A free weight unit with a spinning mass element, which comprises a casing for accommodating the spinning mass element in a rotatable manner about a rotation axis, and also accommodating an electric motor for rotationally driving the mass element and a battery for the electric motor. This free weight unit is designed to be used effectively for training, rehabilitating or physical exercising of the human body, and the-casing generally has a relatively large dimension sufficient to accommodate a relatively large mass element, which may be difficult to be gripped directly by hand. In this free weight unit, a certain vector of the precessional output torque is generated due to an input torque applied to the spinning mass element rotating about the rotation axis, by operating a selected one of the two elongated sections of the shiftable member to turn about a certain input axis extending in a direction different from a direction of the rotation axis.

9 Claims, 10 Drawing Sheets

WEIGHT UNIT WITH ROTATABLE MASS

This application is a continuation-in-part of application Ser. No. 08/795,420 filed Feb. 4, 1997, now abandoned.

BACKGROUND OF THE INVENTION

1. Field of the Invention

The present invention relates generally to a structure used as a weight, and more particularly to a free weight unit including a rotatable mass element for producing precessional torque which cause an additional load to act in addition to the weight of the weight unit. The present invention may be embodied, for example, as a free weight unit which is used effectively for training or rehabilitating the physical strength of an operator in good health or physically handicapped by utilizing the additional load, or a free weight unit used effectively for physical exercises of an astronaut by utilizing a precessional torque in gravity-free state in space, but it will be appreciated that it is also useful in other applications.

2. Description of the Related Art

Free weight units composed of mass structures, which may be used, e.g., for physical exercises, have been well known in the art. Conventional free weight units widely used are normally composed of integral mass structures made of metal such as iron or lead, or of wood. Composite free weight units including casings of, e.g., plastics, for enclosing above-mentioned mass structures therein are also well known. These types of conventional free weight units utilize mainly the force of gravity acting on the units, which depends on the weight of the mass structures. In other words, when the conventional weight units are used for physical exercises, operator's muscles may generally be strengthened by a relatively simple motion for resisting mainly the weight of the units. Such a relatively simple motion is monotonous.

SUMMARY OF THE INVENTION

Accordingly, it is an object of the present invention to provide an improved free weight unit which exerts an additional load acting in addition to the weight of the unit.

It is another object of the present invention to provide a free weight unit which may be used for strengthening operator's muscles by more complicated exercises in comparison with the conventional weight unit utilizing mainly the force of gravity.

In accordance with the present invention, there is provided a weight unit comprising at least one mass element capable of rotating about a respective one axis of rotation; means for rotationally driving the mass element about the axis of rotation at desired speed; and means for rotatably supporting the mass element and fixedly supporting the driving means; wherein, when an input torque is applied to the mass element rotating at desired speed by turning the supporting means together with the mass element about an input axis extending in a direction different from a direction of the axis of rotation, a precessional output torque produced due to gyroscopic characteristics of the mass element is applied to the supporting means, to enable the weight unit to exert an additional load acting in addition to the weight of the weight unit.

The present invention is further characterized by a free weight unit with a spinning mass element, which comprises a casing for accommodating the spinning mass element in a rotatable manner about a rotation axis, and also accommodating an electric motor for rotationally driving the mass element and a battery for the electric motor. This free weight unit is designed to be used effectively for training, rehabilitating or physical exercising of the human body, and the-casing generally has a relatively large dimension sufficient to accommodate a relatively large mass element, which may be difficult to be gripped directly by hand.

The free weight unit of the invention essentially includes a shiftable member adapted to be used as a handle or operating bar. The shiftable member is connected to the casing to be pivotable over 360 degrees around the casing about a pivot axis perpendicular to the rotation axis of the spinning mass element, and includes two elongated sections, one extending along a first axis parallel to the pivot axis and the other extending along a second axis perpendicular to the first axis. The free weight unit of the invention further includes connecting means for connecting the shiftable member to the casing. The connecting means permits the shiftable member to pivot about the pivot axis over 360 degrees around the casing and to be optionally clamped at a desired one of various angle positions around the casing.

In this free weight unit, a certain vector of the precessional output torque is generated due to an input torque applied to the spinning mass element rotating about the rotation axis, by operating a selected one of the two elongated sections of the shiftable member to turn about a certain input axis extending in a direction different from a direction of the rotation axis. Before turning the selected one elongated section about the input axis, i.e., applying the input torque to the spinning mass element, the shiftable member is clamped at the desired one of various angle positions around the casing by the connecting means. The input axis is selected among the first axis, the second axis and a third axis perpendicular to both the first and second axes.

It is possible to apply various input torques to the spinning mass element, to generate various vectors of the precessional output torque, solely by turning the selected one, elongated section about the selected one of the first, second and third axes, since these three input axes can be located at various positions relative to the rotation axis of the mass element, by pivoting the shiftable member over 360 degrees around the casing. Further, in the same angle position of the shiftable member around the casing, solely by changing the elongated section to be operated into the other one, the different vector of the precessional output torque is generated by operating the other elongated section in the same turning action of the hand or foot of the operator as in the case of operating the former elongated section. Moreover, solely by shifting one elongated section having the first axis over the 180 degrees around the casing, the same effect as the reverse of the rotation direction of the mass element may be obtained when the shifted one elongated section is operated, without reversing the rotation direction. These advantages make the free weight unit possible to be effectively used for the various exercises of muscles required for different purposes, e.g., different sports, without complicating the structure of the weight unit.

In this manner, this free weight unit can obtain various vectors of the precessional output torque by variously setting the selected one elongated section of the shiftable member, and the desired one angle position of the shiftable member around the casing, as well as the certain input axis selected among the first, second and third axes.

In the above weight unit, the driving means may include an electric motor and means for variably adjusting an output speed of said electric motor. In this case, it is preferred that the weight unit further comprises a battery for the electric motor, the battery being supported by the supporting means. Alternately, the driving means may include a spring/gear mechanism and means for variably adjusting an output speed of the spring/gear mechanism.

It is advantageous that the supporting means includes a casing for rotatably supporting and enclosing the mass element, and a section shiftably connected to the casing and adapted to change a direction of the axis of rotation relative to the section when the section is shifted on the casing. In this arrangement, when the input torque is applied through the section to the mass element, the relationship between the axis of rotation and the input axis can be changed by shifting the section, whereby the precessional torque can be varied even if the same input torque relative to the section is applied.

It is also advantageous that the supporting means includes a casing for rotatably supporting and enclosing the mass element, and a section connected to the casing and adapted to be used by an operator to permit the weight unit to be used as a dumbbell. In this arrangement, an operator's muscles can be strengthened by more complicated exercises utilizing an additional load caused corresponding to desired input torque applied by the operator. Therefore, the physical exercises using this unit becomes more interesting.

The section may include a grip adapted to be grasped by at least one hand of an operator. Alternatively, the section may include a flexible strip adapted to be used to put the weight unit on a desired portion of a body of an operator.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENTS

Figure 1:
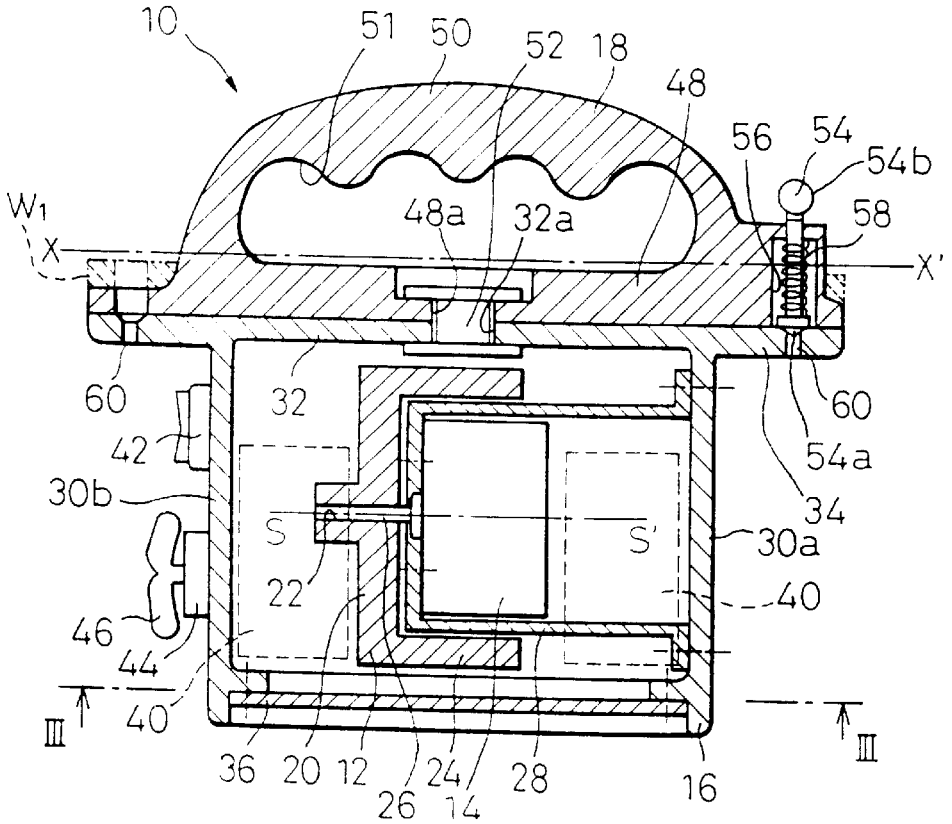
FIG. 1 is a vertical sectional view of the first embodiment of a free weight unit according to the present invention.
Figure 2:
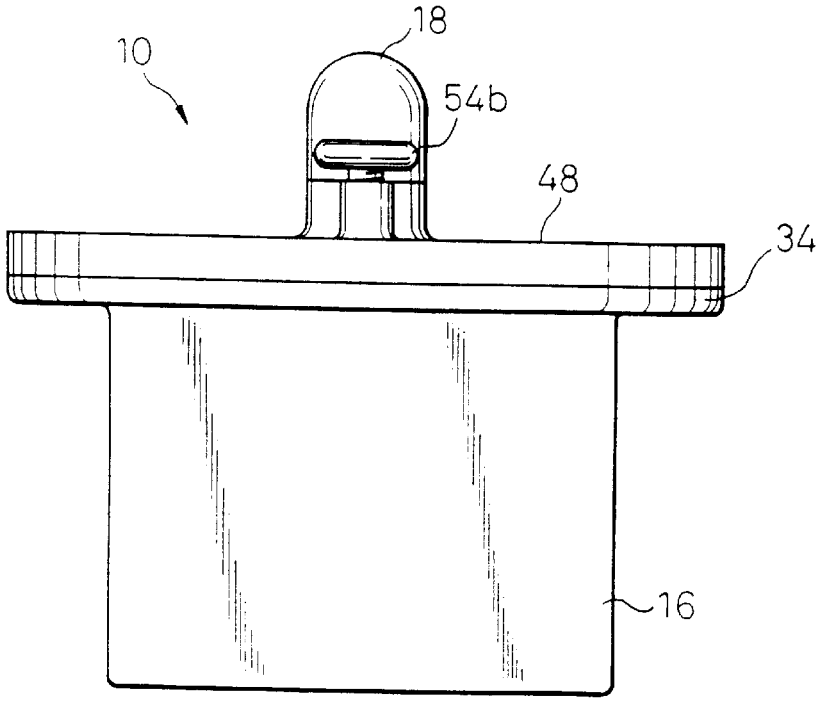
FIG. 2 is a side view of the weight unit of FIG. 1.
Figure 3:
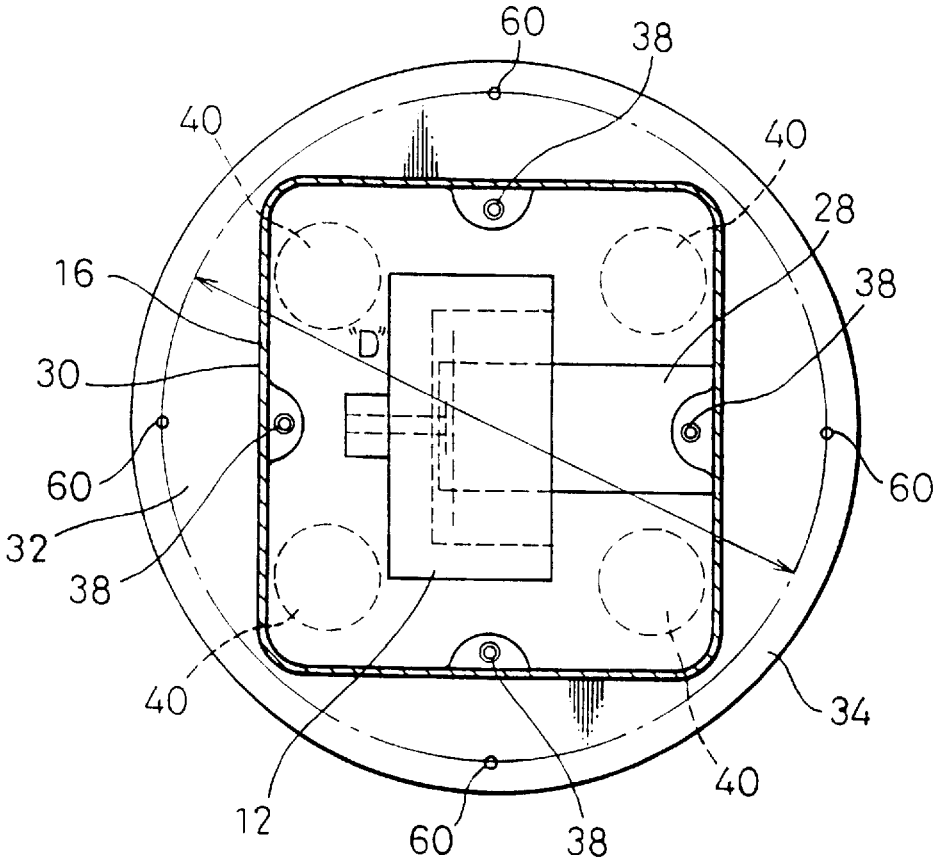
FIG. 3 is a cross-sectional view of the weight unit taken along line III—III of FIG. 1, to reveal a rotor mechanism enclosed in a casing.

Referring now to the drawings, wherein like reference numerals designate like or corresponding parts throughout the several views, FIGS. 1 to 3 diagrammatically show the first embodiment of a free weight unit 10 according to the present invention. The weight unit 10 is designed to be used for physical exercises, and includes a single rotatable mass element 12, an electric motor 14 for rotationally driving the mass element 12, a casing 16 for rotatably enclosing the mass element 12 and fixedly supporting and enclosing the motor 14, and a grip member 18 shiftably connected to the casing 16.

The mass element 12 includes an end plate 20 shaped as a circular disk provided with a center bore 22 extending along an axis S-S' of the mass element 12, and a cylindrical sleeve 24 extending parallel to the axis S-S' on one side of the end plate 20 and integrally joined to the peripheral edge of the end plate 20. The mass element 12 is provided with proper moment of inertia about the axis S-S', and thus can rotate in a balanced state about the axis S-S'. An output shaft 26 of the motor 14 is secured in the center bore 22 of the end plate 20 by, e.g., an adhesive or bolts, whereby the motor 14 rotationally drives the mass element 12 about the axis S-S'.

The motor 14 is a conventional inner-rotor motor, and is secured to a frame member 28. As shown in FIG. 1, the frame member 28 is fixedly attached to the inner surface of one side wall 30*a* of the casing 16, and partially received in the mass element 12 so that the mass element 12 can rotate without any interference with the frame member 28 and the casing 16. Also, the axis S-S' of rotation of the mass element 12 and the shaft 26 of the motor 14 extend generally perpendicular to the side wall 30*a*. Alternatively, a conventional outer-rotor motor may be used for driving means. In this case, the inner stator of the motor may be secured to the casing 16 and the outer rotor of the motor may be fixed to the inner surface of the sleeve 24 of the mass element 12, which will eliminate the frame member 28.

As best seen in FIG. 3, the casing 16 includes a tubular side wall portion 30 with a generally square cross-section and a circular top wall portion 32 integrally joined to one end of the side wall portion 30 to substantially close the one end. The top wall portion 32 extends generally perpendicular to the side wall portion 30, and also extends radially beyond the side wall portion 30 to form a circular flange 34. The other open end of the side wall portion 30 is closed by a lid 36 detachably fitted to the side wall portion 30. The lid 36 may be fitted to the inner projections of the side wall portion 30 formed near the open end thereof by bolts (not shown) which may be screwed in threaded holes 38 formed in the inner projections.

Figure 4:
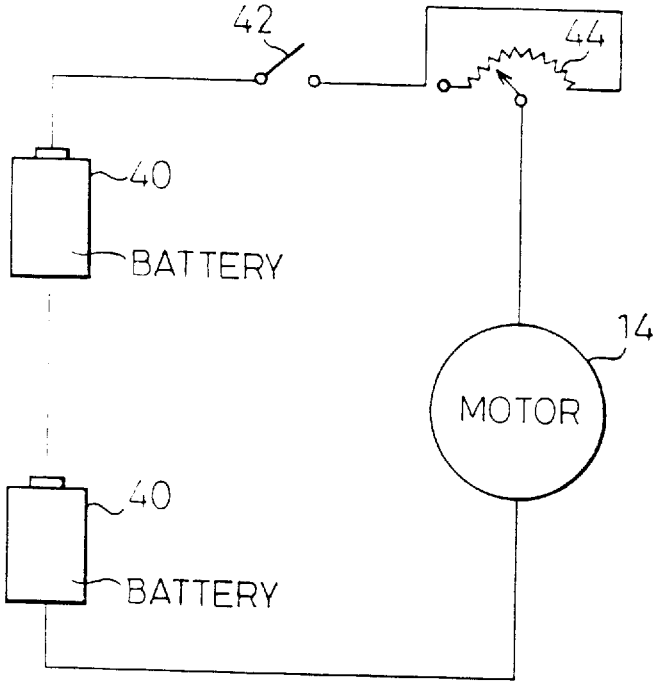
FIG. 4 illustrates a power source circuit of the weight unit of FIG. 1, in the case of using dry batteries as a driving power source of an electric motor used in the rotor mechanism.

The casing 16 may further enclose dry batteries 40 as a power source for the motor 14. In the illustrated embodiment, four dry batteries 40 are shown (FIG. 3). The batteries 40 may be exchanged for new ones through the open end of the casing 16 by detaching the lid 36. A switch 42 for selectively opening/closing a power source circuit for the motor 14, and a variable resistor 44 for variably adjusting the output speed of the motor 14 are mounted on another side wall 30*b* of the casing 16, so that an operator can operate the switch 42 and the resistor 44 from the outside of the casing 16. The resistor 44 may be provided with a knob 46 used by an operator to easily adjust the speed of the motor 14. The motor 14, the dry batteries 40, the switch 42 and the resistor 44 are connected in series through terminal plates and electric wiring (not shown) suitably laid in the casing 16. The power source circuit of the weight unit 10 is shown in FIG. 4.

The grip member 18 includes a circular base 48, the diameter of which is generally identical to the diameter of the top wall portion 32 of the casing 16, and a grip 50 integrally joined to the upper side of the base 48. The grip 50 has an ergonomical shape to be surely grasped by one hand of an operator with four fingers except for a thumb respectively lying on four depressions 51 of the grip 50. The grip member 18 is pivotably connected to the top wall portion 32 of the casing 16 by a pivot shaft 52 with the lower side of the base 48 being abutted onto the upper side of the wall portion 32, and with the outer edges of the base 48 and wall portion 32 being aligned with each other. The pivot shaft 52 extends through a center hole 48*a* of the base 48 and a center hole 32*a* of the top wall portion 32. The pivot shaft 52 may be constructed by two parts, each of which includes a mutually engageable portion in a screwing manner and an end flange. As shown in FIG. 1, when these parts are inserted into the center holes 32*a*, 48*a* and joined together by mutually screwing the engageable portions, the end flanges of the shaft 52 may hold the top wall portion 32 and the base 48 therebetween.

The grip member 18 also includes a spring loaded plunger 54 arranged in a bore 56 formed at a position near the outer edge of the base 48. The plunger 54 includes a conical end 54*a* and is normally biased by a spring 58 also arranged in the bore 56 in such a direction that the conical end 54*a* projects from the lower side of the base 48. The plunger 54 also includes a knob 54*b* to be operated by an operator, which is formed at another end of the plunger 54 extending outside through the base 48. The top wall portion 32 of the casing 16 is provided in the flange 34 with a plurality of holes 60 disposed on a virtual circle with a diameter D (see FIG. 3), which are positioned to be alignable to the conical end 54*a* of the plunger 54 of the grip member 18. In the illustrated embodiment, four holes 60 are disposed at regular intervals along the virtual circle, i.e., are separated from each other in respective center angles of 90 degrees. Of course, five or more holes may be provided along the virtual circle in the top wall portion 32.

The grip member 18 can be shifted about the pivot shaft 52 and located at every desired fixed positions relative to the casing 16, at which the conical end 54*a* of the plunger 54 is engaged into any one of the holes 60 under the force of the spring 58. In the condition of FIG. 1, the grip member 18 is located at a fixed position at which an axis X-X' of the grip 50, i.e., of a tubular-shaped hand of an operator grasping the grip 50, is generally parallel to the rotation axis S-S' of the mass element 12. When the grip member 18 is shifted 90 degrees about the pivot shaft 52 from the condition of FIG. 1, and the conical end 54*a* of the plunger 54 is brought into engagement with the next hole 60, the grip member 18 is located at the second fixed position at which the axis X-X' of the grip 50 is generally perpendicular to the rotation axis S-S' of the mass element 12.

In this manner, the weight unit 10 can optionally change the angle defined between the grip axis X-X' and the rotation axis S-S', so as to vary a precessional effect due to gyroscopic characteristics of the mass element 12 as mentioned in detail below.

Figure 5:
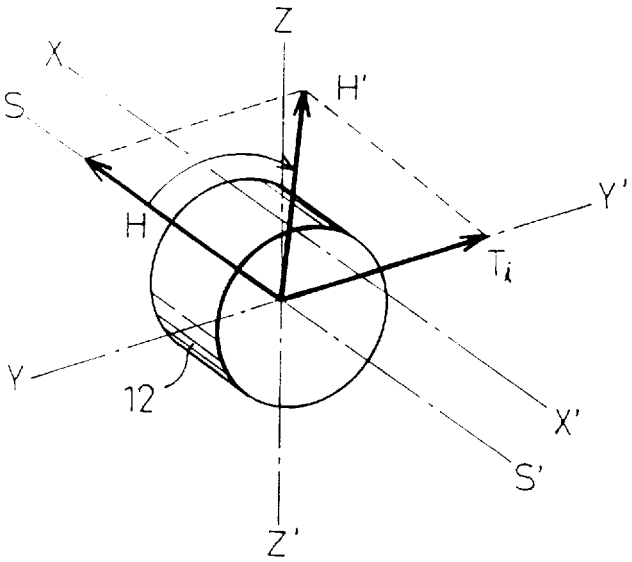
FIG. 5 is a schematic illustration for explaining the relationship between an input torque and an additional load caused due to an output precessional torque.

The weight unit 10 structured in the above-mentioned manner can produce a precessional torque which can cause an additional load to act in addition to the total weight of the unit 10, due to gyroscopic characteristics of the mass element 12 rotating at high speed. FIG. 5 schematically illustrates the additional load in relation to the mass element 12 in a rectangular coordinate system including the rotation axis S-S', the grip axis X-X', an axis Y-Y' of an input torque for causing a gyroscopic effect in the mass element 12, and an axis Z-Z' of a precessional output torque resulted in the mass element 12. FIG. 5 shows such a condition that the rotation axis S-S' is parallel to the grip axis X-X', which is the same as the condition of FIG. 1.

In FIGS. 1 and 5, when the mass element 12 is rotated in a clockwise direction about the axis S-S' as seen from a S'-side at high speed due to the motor 14, a certain angular momentum H of the mass element 12 is produced (an angular momentum vector H is shown in FIG. 5). When an operator grasps the grip 50 in one hand and swings or turns the weight unit 10 substantially about the input axis Y-Y', which is perpendicular to the rotation axis S-S', in a counterclockwise direction about the axis Y-Y' as seen from a Y'-side, by, e.g., bending the wrist of the hand, an input torque Ti is applied in a counterclockwise direction to the rotating mass element 12 (an input torque vector Ti is also shown in FIG. 5). A precessional output torque is thus produced on the mass element 12 about the output axis Z-Z', which is perpendicular to both the rotation axis S-S' and the input axis Y-Y', in a counterclockwise direction about the axis Z-Z' as seen from a Z'-side, due to gyroscopic characteristics of the rotating mass element 12. The precessional output torque acts in such a direction that the end plate 20 of the mass element 12, i.e., a S-side of the rotation axis S-S' in FIG. 5, is turned toward a vector H' which is sum of the angular momentum vector H and the input torque vector Ti.

As a result of this, the weight unit 10 permits an additional load caused by the precessional output torque to act additionally with the total weight of the weight unit 10 on the operator's hand, as a torsional force acting on the wrist of the operator. When an input torque is applied about the axis Z-Z'by, e.g., twisting the wrist of the operator, the precessional output torque will be produced about the axis Y-Y' which causes an additional load to act to bend the wrist of the operator. Therefore, the physical exercises using this unit 10 will become more interesting.

In the weight unit 10, various input torque axes may be selected relative to the rotation axis S-S', provided that no input torque axis is parallel to the rotation axis S-S', to produce different precessional output torques acting in various directions. Also, when the grip member 18 is variously shifted relative to the casing 16, the same motion or exercise of the wrist or arm of an operator will cause different precessional output torque or additional loads. Further, to cause different precessional output torque or additional loads, the directions and/or magnitude of the vectors of angular momentum of the mass element and/or the input torque applied by an operator, i.e., the rotational direction and/or speed thereof, may variously be selected by, e.g., adjusting the output speed of the motor 14 by operating the variable resistor 44.

The total weight of the weight unit 10 may be changed by suitably selecting the materials of the mass element 12, the casing 16 and/or the grip member 18. The selection of the mass element 12 also affects the precessional output torque. The total weight of the weight unit 10 may be increased by mounting a desired number of additional weight $W_1$, (see FIG. 1) on the grip member 18. The additional weight $W_1$, may have an annular shape to be mounted on the peripheral area of the base 48, and may be clamped to the base 48 by suitable clamping means, such as bolts and nuts using holes provided in an alignable manner in the weight $W_1$, the base 48 and the flange 34.

Figure 6:
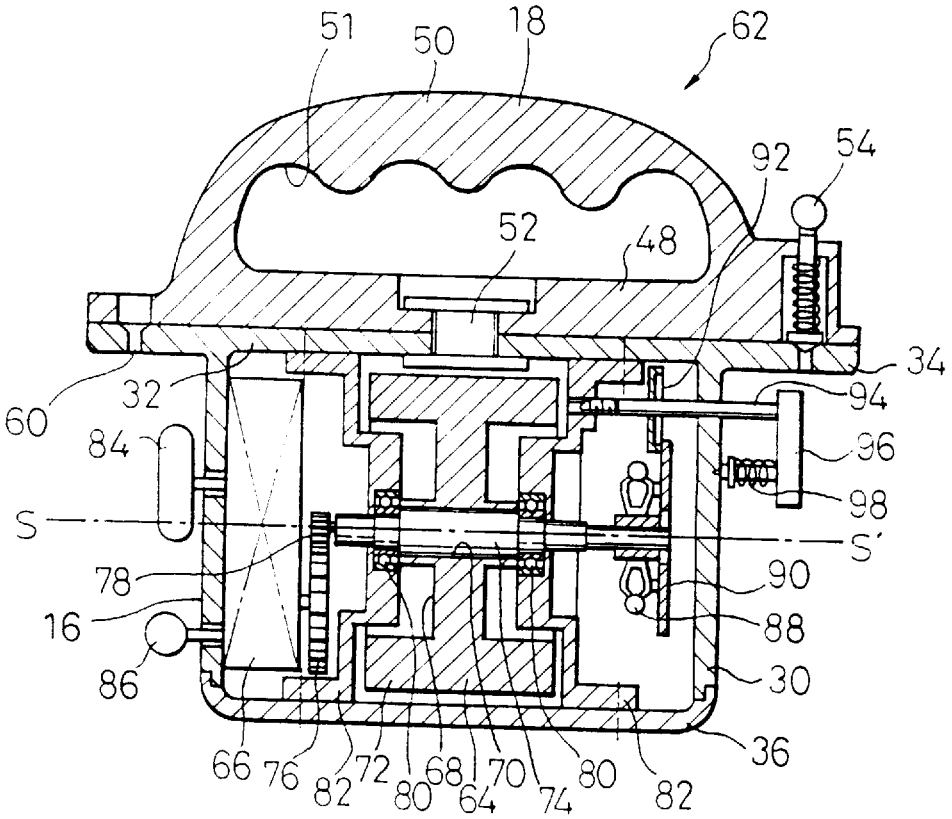
FIG. 6 is a vertical sectional view of the second embodiment of a free weight unit according to the present invention.
Figure 7:
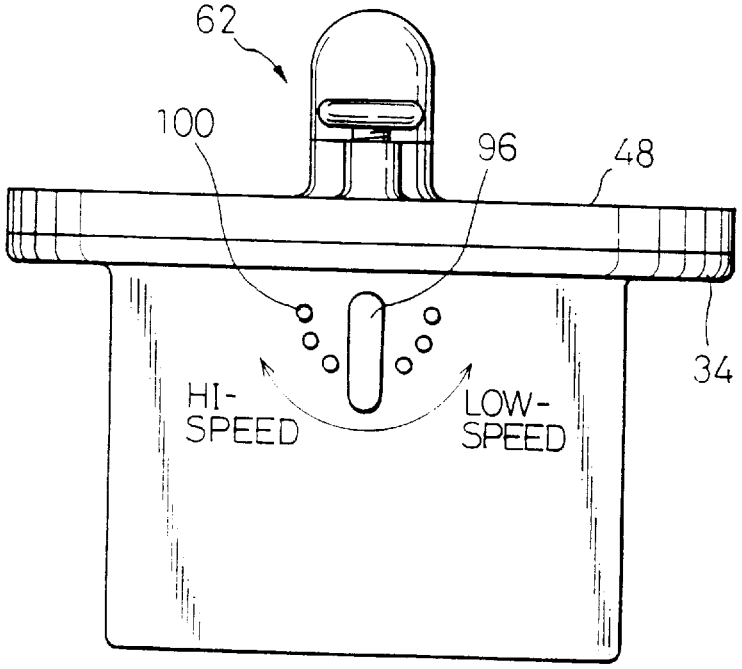
FIG. 7 is a side view of the weight unit of FIG. 6.

FIGS. 6 and 7 show the second embodiment of a free weight unit 62 according to the present invention. The weight unit 62 is similar to the weight unit 10 of FIG. 1, without the structure of a rotatable mass element and driving means for rotating the mass element. Thus, the weight unit 62 includes a single rotatable mass element 64, a spring/gear mechanism 66 for rotationally driving the mass element 64, a casing 16 for rotatably enclosing the mass element 64 and fixedly supporting and enclosing the mechanism 66, and a grip member 18 pivotably connected to the casing 16.

The mass element 64 includes a center plate 68 shaped as a circular disk provided with a center bore 70 extending along an axis S-S' of the mass element 64, and a cylindrical sleeve 72 extending parallel to the axis S-S' on both sides of the center plate 68 and integrally connected to the peripheral edge of the center plate 68. The mass element 64 is provided with proper moment of inertia about the axis S-S', and thus can rotate in a balanced state about the axis S-S'. An output shaft 74 of the spring/gear mechanism 66 is secured in the center bore 70 of the center plate 68 by, e.g., an adhesive or bolts, whereby the mechanism 66 rotationally drives the mass element 64 about the axis S-S'.

The spring/gear mechanism 66 includes an output gear 76 engageable with a small gear 78 fixed to one end of the output shaft 74. The shaft 74 is rotatably carried by a pair of bearings 80 mounted on a pair of frame members 82. The frame members 82 are fixedly attached to the inner surfaces of the top wall portion 32 and the lid 36 of the casing 16 by suitable fixing means such as bolts, so that the mass element 64 can rotate without any interference with the frame members 82 and the casing 16. Also, the axis S-S' of rotation of the mass element 64 and the shaft 74 of the mechanism 66 extend generally perpendicular to the side wall portion 30 of the casing 16. The spring/gear mechanism 66 also includes a knob 84 for winding up a power spring (not shown) to store a drive power, and a switch 86 for locking/unlocking the rotation of the output gear 76 due to the power stored in the power spring. The knob 84 and the switch 86 are mounted on the side wall portion 30 of the casing 16, so that an operator can operate the knob 84 and the switch 86 from the outside of the casing 16.

The weight unit 62 further includes means for variably adjusting an output speed of the spring/gear mechanism 66. This means includes a governor 88 composed of centrifugal weights and elastic arms, which is affixed to another end of the shaft 74 opposite to the small gear 78. An end plate 90 of the governor 88 is arranged so as to be abutted to a friction plate 92 fixed to a shaft 94 which extends through the side wall portion 30 of the casing 16. One end of the shaft 94 has a threaded portion and is engaged into a threaded hole formed on one frame member 82, while the other end of the shaft 94 extends outside the casing 16 and is provided with a lever 96. When an operator operates the lever 96 to turn the shaft 94, the shaft 94 and the friction plate 92 are axially shifted to vary a contact pressure and thus a friction force acting between the friction plate 92 and the end plate 90, whereby the rotation speed of the output shaft 74 and thus of the mass element 64 is variably adjusted.

Preferably, the lever 96 may be provided with a spring-loaded plunger 98 extending toward the outer surface of the side wall portion 30, and the side wall portion 30 may be provided on the outer surface thereof with a plurality of dents 100 located engageable with the tip end of the plunger 98. In this case, the lever 96 and the friction plate 92 can be selectively located at desired fixed positions, by an engagement of the plunger 98 with one dent 100, so that the speed of the mass element 64 is properly adjusted, while eliminating an inadvertent rotation of the lever 96.

Figure 8:
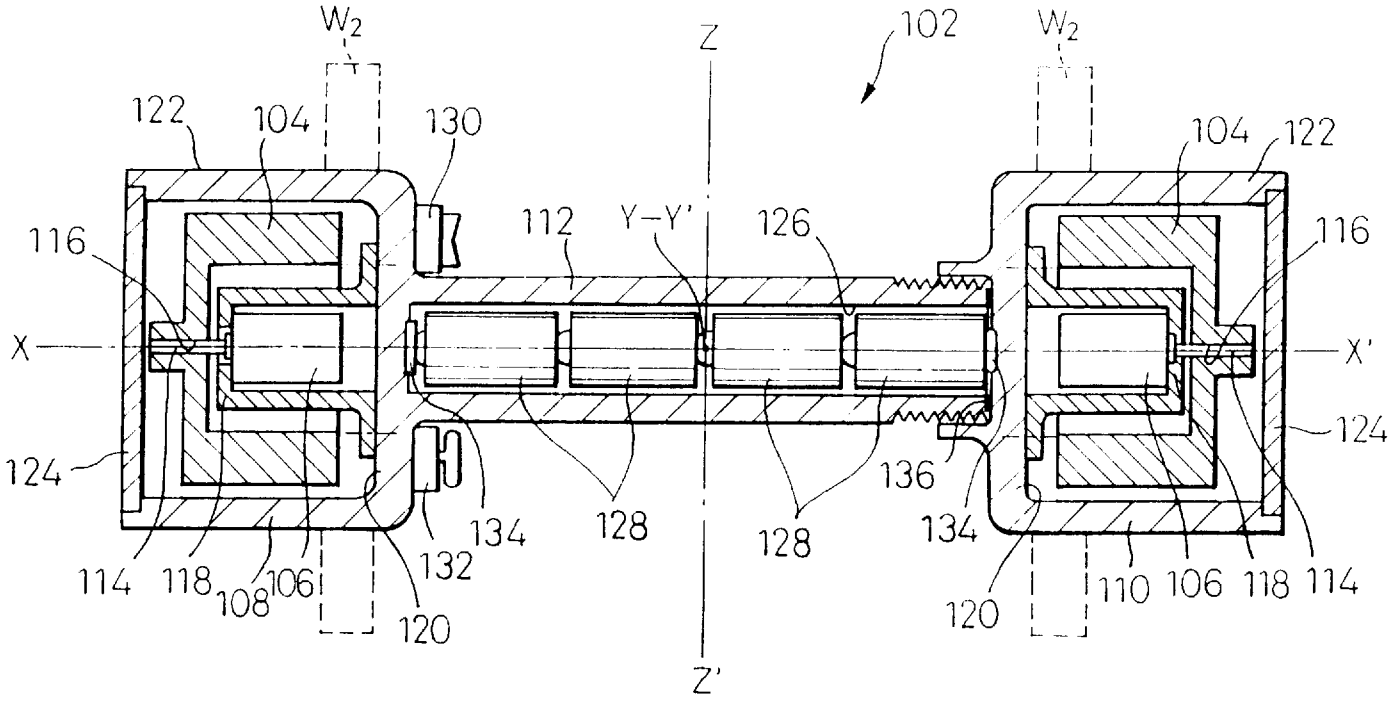
FIG. 8 is a vertical sectional view of the third embodiment of a free weight unit according to the present invention.

FIG. 8 shows the third embodiment of a free weight unit 102 according to the present invention. The weight unit 102 is designed to be used as a dumbbell for physical exercises, and includes two rotatable mass elements 104, two electric motors 106 for rotationally driving each of the mass elements 104, first and second casings 108, 110 for rotatably enclosing each of the mass elements 104 and fixedly supporting and enclosing each of the motors 106, and a grip member 112 connected to the casings 108, 110.

Each mass element 104 and each motor 106 are similar to the mass element 12 and the motor 14 of the weight unit 10 of FIG. 1, and thus are not described in full detail. It should be only noted that the mass elements 104 have a common axis X-X' of rotation, and can rotate in a balanced state about the axis X-X'. Output shafts 114 of the motors 106 secured in center bores 116 of the mass elements 104 are directed in mutually opposite direction. The motors 106 are secured to frame members 118, and the frame members 118 are fixed to the inner surfaces of side walls 120 of the casings 108, 110.

The casings 108, 110 include circular side walls 120 and cylindrical walls 122 integrally joined to peripheral edges of the side walls 120. The cylindrical walls 122 extend generally perpendicular to the side walls 120. The open ends of the cylindrical walls 122 are closed by lids 124. The grip member 112 has a cylindrical wall, of which diameter is smaller than the diameters of the cylindrical walls 122 of the casings 108, 110. The grip member 112 is fixed at one axial end thereof to the outer surface of the side wall 120 of the first casing 108. In the illustrated embodiment, the grip member 112 is preferably formed integrally with the first casing 108. The other axial end of the grip member 112 is provided on the outer surface thereof with a threaded portion which can be detachably engaged with a counterpart threaded portion formed on the outer surface of the side wall 120 of the second casing 110. When the second casing 110 is properly assembled to the grip member 112, the first casing 108, the grip member 112 and the second casing 110 are coaxially located, and the axis of this assembly is identical to the axis X-X' of rotation of the mass elements 104.

The grip member 112 defines, inside the cylindrical wall thereof, a bore 126 for accommodating dry batteries 128 as a power source of the motors 106. In the illustrated embodiment, four dry batteries 128 are shown. The batteries 128 may be exchanged for new ones through the open end of the grip member 112 by detaching the second casing 110 therefrom. A switch 130 for selectively opening/closing a power source circuit for the motors 106, and a variable resistor 132 for variably adjusting the output speed of the motors 106 are mounted on the side wall 120 of the first casing 108, so that an operator can operate the switch 130 and the resistor 132 from the outside of the casing 108. The motors 106, the dry batteries 128, the switch 130 and the resistor 132 are connected in series through terminal plates 134 respectively disposed on the outer surfaces of the side walls 120 of the casings 108, 110 and electric wiring (not shown) suitably laid in the casings 108, 110 and the grip member 112.

It is preferred that a power source circuit for the motors 106 as mentioned above is not closed until the second casing 110 is fully assembled to the grip member 112 at a predetermined position. In other words, it is preferred that, just when the second casing 110 is fully screwed onto and firmly secured to the grip member 112, the dry batteries 128 and the terminal plates 134 are finally electrically connected. This arrangement may permit an operator to notice the misassembly of the second casing 110, and may prevent any injury caused due to the inadvertent dropping off of the second casing 110. It is also preferred that a washer 136 is disposed between the second casing 110 and the grip member 112 for preventing a loosening of the thread portions thereof.

In the weight unit 102, two mass elements 104 rotate about the axis X-X' in the same direction to produce the same vector of angular momentum on the unit 102. Therefore, two electric motors 106 should output respective torque in opposite directions, and batteries 128 should be connected to the motors 106 to ensure such a mutually opposite driving. This weight unit 102 can also produce a precessional torque which cause an additional load acting additionally with the total weight of the unit 102, due to the gyroscopic characteristics of the mass elements 104 rotating at high speed.

In the weight unit 102 of FIG. 8, when an operator grasps the grip member 112 in one hand and swings or turns the weight unit 10 substantially about an axis Y-Y', which is perpendicular to the rotation axis X-X', to apply an input torque to the rotating mass elements 104, a precessional output torque is produced on the mass elements 104 about an axis Z-Z', which is perpendicular to both the rotation axis X-X' and the input axis Y-Y', due to gyroscopic characteristics of the rotating mass elements 104. When an input torque is applied about the axis Z-Z', a precessional output torque is produced about the axis Y-Y'.

In the embodiment of FIG. 8, it is possible to change the direction of the axis of rotation of the mass elements 104 by, e.g., affixing the frame members 118 to the cylindrical walls 122 of the casings 108, 110. For example, the axes of rotation of both of the mass elements 104 may be made perpendicular to the axis X-X' and parallel to the axis Z-Z', to be directed in the mutually same direction. In this arrangement, when an input torque is applied about the axis X-X', a precessional output torque is produced about the axis Y-Y', and when an input torque is applied about the axis Y-Y', a precessional output torque is produced about the axis X-X'.

Further, in the embodiment of FIG. 8, it is possible to direct the axes of rotation of the mass elements 104 in different directions from each other. This arrangement will make it possible for the mass elements 104 to produce different precessional output torque acting in different directions, which will act as a resultant force providing various sensations to an operator.

Figure 9:
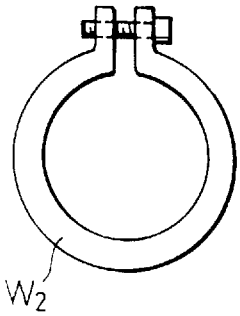
FIG. 9 is a front view of a C-ring weight detachably mounted to the weight unit of FIG. 8.

The total weight of the weight unit 102 may be changed by suitably selecting the materials of the mass elements 104, the casings 108, 110 and/or the grip member 112. Also, the total weight of the weight unit 102 may be increased by mounting a desired number of additional weights $W_2$ on the casings 108, 110. As shown in FIG. 9, the additional weights $W_2$ may have a C-ring shape to be mounted on the circumferential surface of the cylindrical wall 122, and may be clamped to the cylindrical wall 122 by suitable clamping bolt and nut.

FIGS. 10 to 15 show the fourth embodiment of a free weight unit 140 according to the present invention. The weight unit 140 is designed to be used for physical exercises, and includes a rotatable mass element 142, an electric motor 144 for rotationally driving the mass element 142, a casing 146 for rotatably enclosing the mass element 142 and fixedly supporting and enclosing the motor 144, and a grip member 148 shiftably connected to the casing 146.

Figure 13:
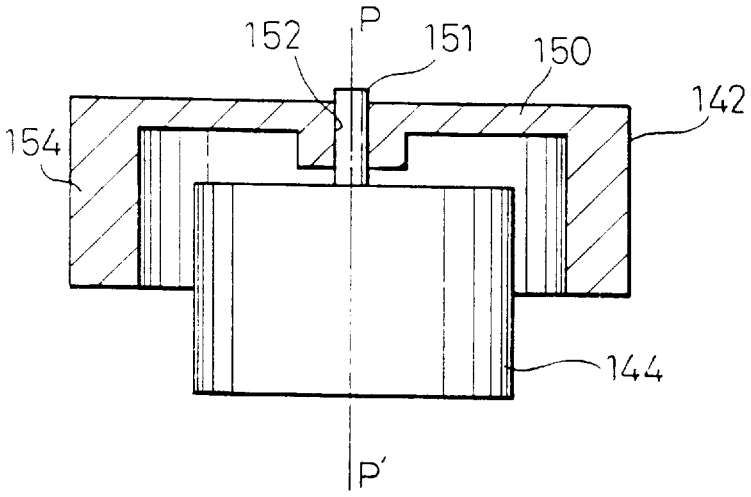
FIG. 13 is an enlarged side view of a rotable mass element in vertical section and an electric motor, both used in the weight unit of FIG. 10.

As shown in FIG. 13, the mass element 142 includes an end plate 150 shaped as a circular disk provided with a center bore 152 extending along an axis P-P' of the mass element 142, and a cylindrical sleeve 154 extending parallel to the axis P-P' on one side of the end plate 150 and integrally connected to the peripheral edge of the end plate 150. The mass element 142 is provided with proper moment of inertia about the axis P-P', and thus can rotate in a balanced state about the axis P-P'. In the illustrated embodiment, for example, the moment of inertia is 15 g cm $s^2$. An output shaft 151 of the motor 144 is secured in a center bore 152 of the mass element 142, whereby the motor 144 rotationally drives the mass element 142 about the axis P-P'.

The motor 144 is of a conventional D.C. brushless motor, and is secured directly to the inner surface of the casing 146. The motor 144 can rotate the mass element 142 without causing any interference between the element 142 and the casing 146. The output speed of the motor 144 may be variably adjusted by changing an input voltage, so that an angular momentum of the mass element 142 may be optionally changed. In the illustrated embodiment, for example, when the speed of the mass element 142 is 4,000 rpm, the angular momentum thereof becomes 6.6 kg cm s, and when an angular velocity required for applying an input torque is 90 degrees/sec, a precessional output torque becomes 10 kg cm.

The casing 146 includes a cylindrical side wall 156 and a flat circular top wall 158 integrally joined to one end of the side wall 156 to substantially close the one end. The top wall 158 directly carries the motor 144. The open another end of the side wall 156 is closed by a lid 160. The casing 146 further includes a pair of opposed flanges 162 extending radially outward from the outer surface of the side wall 156, and a pair of shafts 164 extending radially outward from and integrally with the outer surfaces of the respective flanges 162.

The grip member 148 has an L-shaped bent tube configuration integrally composed of a section 148*a* extending along an axis L and a section 148*b* extending along an axis M perpendicular to the axis L. The grip member 148 is pivotably connected to the shafts 164 of the casing 146 by a pair of connecting plates 166, 168. The straight connecting plate 166 is fixed at one end thereof to a free end of the section 148*a* and is pivotably fitted at another end thereof to one shaft 164. The bent connecting plate 168 is fixed at one end thereof to a free end of the section 148*b* and is pivotably fitted at another end thereof to another shaft 164. Thus, the grip member 148 can pivot around an axis X-X' of the shafts 164 over 360 degrees, which extends perpendicular to an axis Z-Z' identical to the rotation axis P-P'.

The shafts 164 are provided with clamp knobs 170 which can be tightened to clamp the grip member 148 at a desired angle position by screwing the clamp knobs 170 into the shafts 164. In the position shown in FIG. 10, the grip axis L of the grip member 148 is parallel to the axis X-X' and thus is perpendicular to the rotation axis P-P', while the grip axis M of the grip member 148 is parallel to the rotation axis P-P' (i.e., the axis Z-Z'). When the grip member 148 is pivoted around the axis X-X' 90 degrees from the position shown in FIG. 10, and is fixed at this pivoted position (shown by a broken line in FIG. 11), the grip axis L remains parallel to the axis X-X', while the grip axis M becomes parallel to an axis Y-Y' which extends perpendicular to both the rotation axis P-P' and the axis X-X'. In this manner, an operator can select the grip axis L or M which is located at a desired position relative to a vector of angular momentum.

The weight unit 140 further includes a switch 172 for selectively opening/closing a power source circuit for the motor 144, and a knob 174 for variably adjusting the input voltage to the motor 144, both of which are mounted on the lid 160 of the casing 146, so that an operator can operate the switch 172 and the knob 174 from the outside of the casing 146. The casing 146 also encloses a storage battery (not shown) in a suitable space 176, as a power source of the motor 144, and an electrical terminal 178 for charging the storage battery is provided on the outer surface of the lid 160.

As previously described, the grip member 148 may be secured at a desired angle position over 360 degrees, so that an operator can select a desired input axis extending in a desired direction relative to the rotation axis P-P' and thus easily apply a desired input torque to the mass element 142, to obtain a desired precessional output torque produced due to gyroscopic characteristics of the mass element 142.

Figure 10:
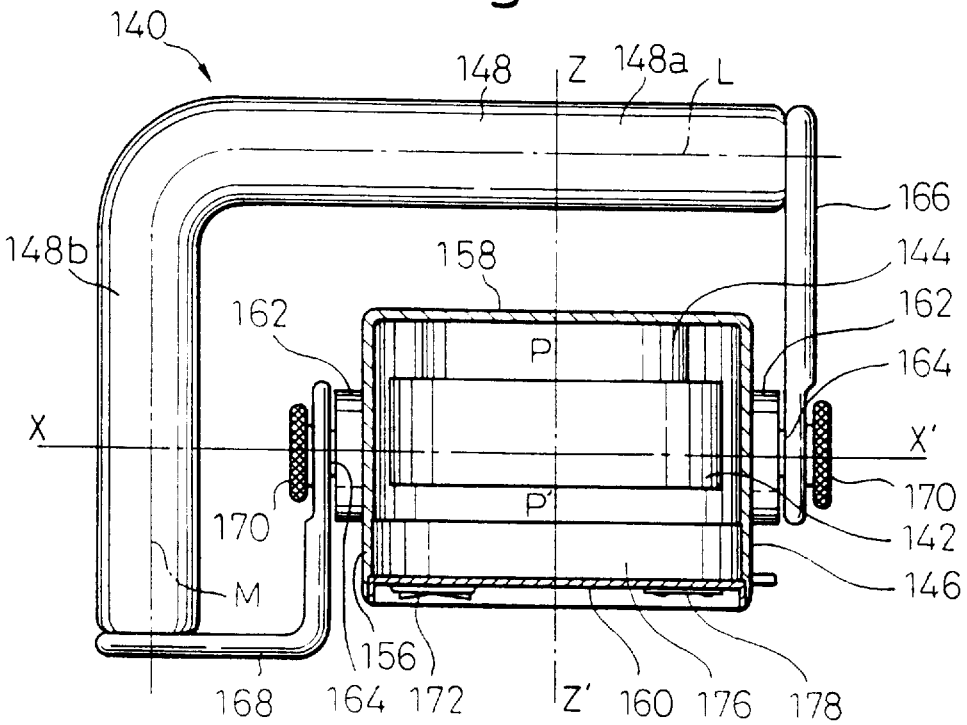
FIG. 10 is a vertical sectional view of the fourth embodiment of a free weight unit according to the present invention.
Figure 14:
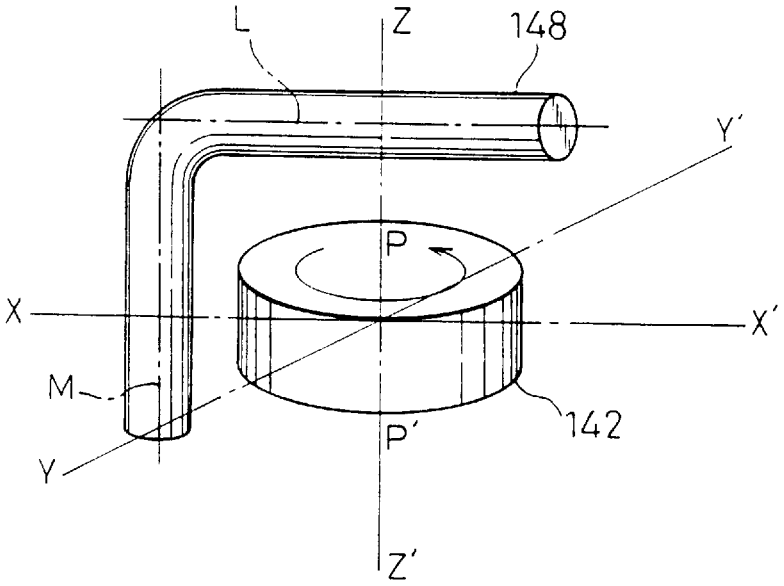
FIG. 14 is a schematic illustration for showing a grip member and a mass element, both used in the weight unit of FIG. 10.

FIG. 14 schematically shows the mass element 142 and the grip member 148 located in the position shown in FIG. 10, in a rectangular coordinate system including the axis X-X', the axis Y-Y' and the axis Z-Z' identical to the rotation axis P-P'. FIG. 14 shows such a condition that the grip axis L is parallel to the axis X-X' and perpendicular to the rotation axis P-P', and the grip axis M is parallel to the rotation axis P-P' and perpendicular to the axis X-X'. The relationship between an input torque shown as a certain exercise performed by an operator gripping the grip member 148 and a precessional output torque shown a a certain additional exercise force to the operator, in the conition of FIG. 14, is illustrated in a table 1.

TABLE I

| Grip Axis | Input Axis | Exercise | Output Axis | Add. Exercise |
|---|---|---|---|---|
| L | X | Wrist Bending | Y | Arm Twisting |
| | Y | Wrist Bending | X | Wrist Bending |
| | Z | Arm Twisting | — | None |
| M | X | Arm Twisting | Y | Wrist Bending |
| | Y | Wrist Bending | X | Arm Twisting |
| | Z | Wrist Bending | — | None |

Figure 11:
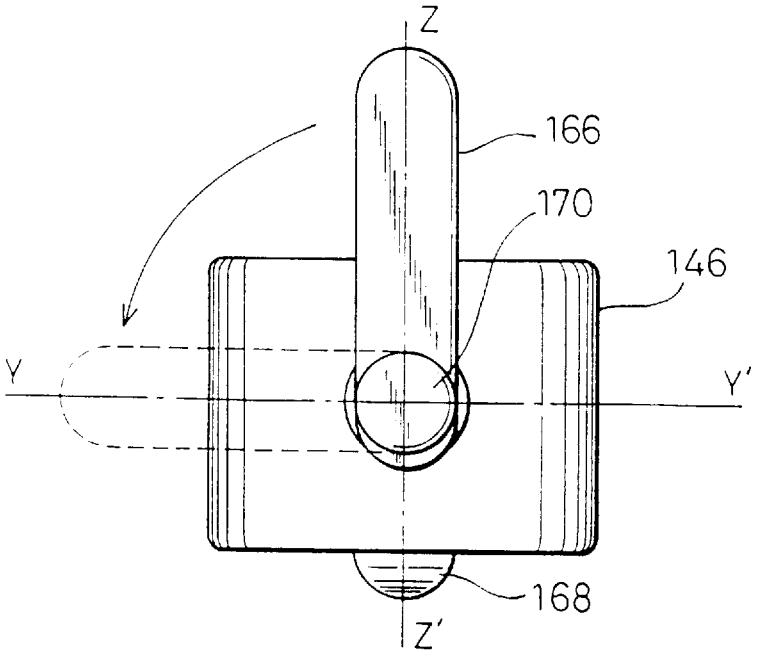
FIG. 11 is a side view of the weight unit of FIG. 10.
Figure 12:
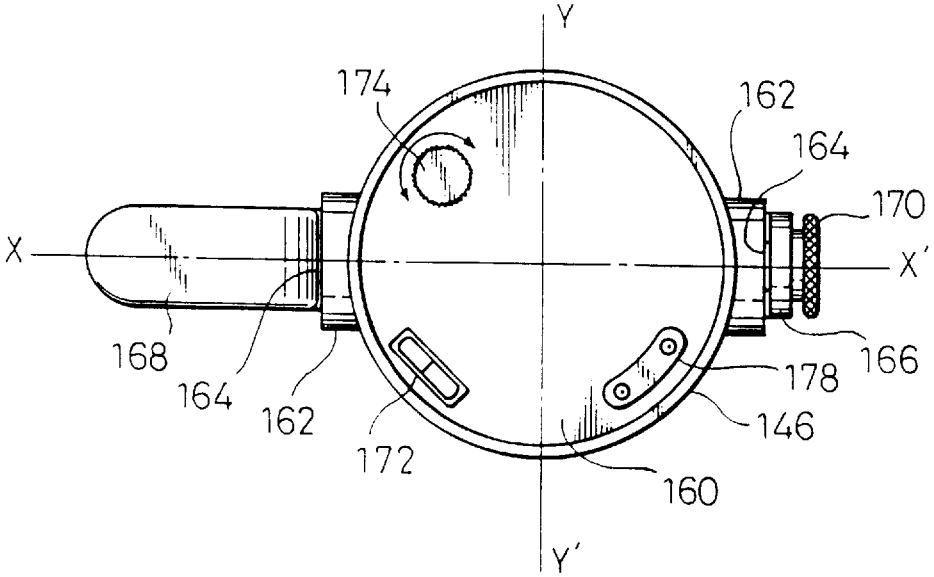
FIG. 12 is a bottom view of the weight unit of FIG. 10.
Figure 15:
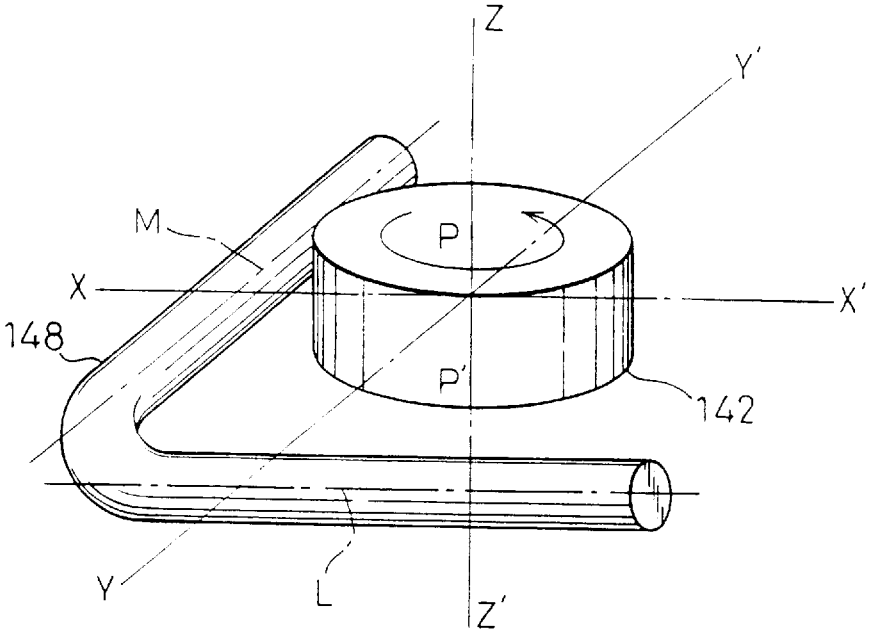
FIG. 15 is a schematic illustration similar to FIG. 14 and showing the state that the grip member is in another position.

FIG. 15 schematically shows the mass element 142 and the grip member 148 located in the position shown by dashed line in FIG. 11, in a rectangular coordinate system including the axis X-X', the axis Y-Y' and the axis Z-Z' identical to the rotation axis P-P'. FIG. 15 shows such a condition that the grip axis L is parallel to the axis X-X' and perpendicular to the axis Y-Y', and the grip axis M is parallel to the axis Y-Y' and perpendicular to the axis X-X'. The relationship between an input torque shown as a certain exercise performed by an operator gripping the grip member 148 and a precessional output torque shown as a certain additional exercise forced to the operator, in the condition of FIG. 15, is illustrated in a table 2.

TABLE 2

| Grip Axis | Input Axis | Exercise | Output Axis | Add. Exercise |
|---|---|---|---|---|
| L | X | Wrist Bending | Y | Arm Twisting |
| | Y | Arm Twisting | X | Wrist Bending |
| | Z | Wrist Bending | — | None |
| M | X | Arm Twisting | Y | Wrist Bending |
| | Y | Wrist Bending | X | Arm Twisting |
| | Z | Wrist Bending | — | None |

Figure 16:
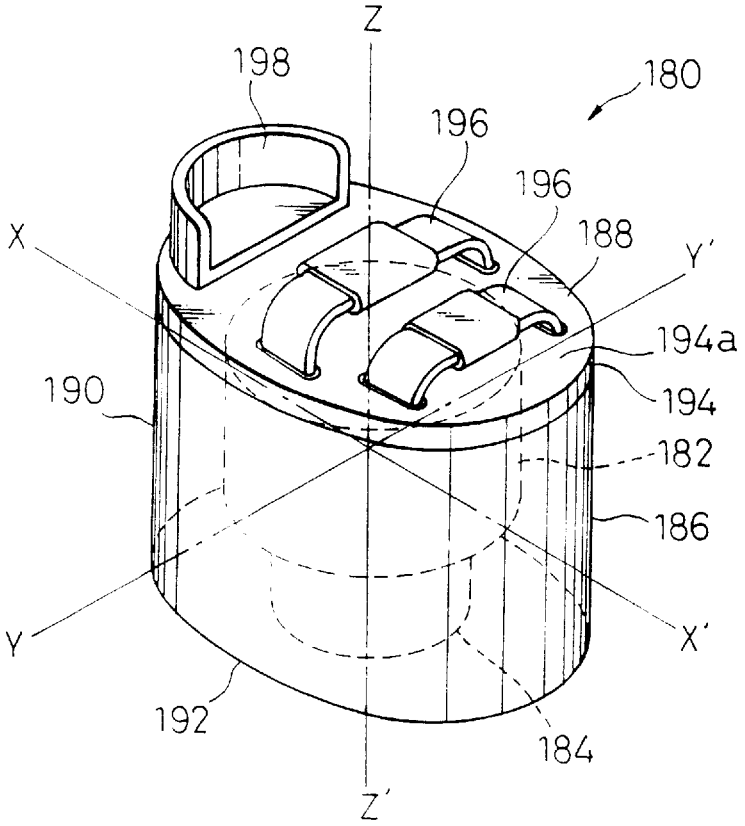
FIG. 16 is a perspective view of the fifth embodiment of a free weight unit according to the present invention.

FIG. 16 shows the fifth embodiment of a free weight unit 180 according to the present invention. The weight unit 180 is designed to be used for physical exercises, and includes a rotatable mass element 182, an electric motor 184 for rotationally driving the mass element 182, a casing 186 for rotatably enclosing the mass element 182 and fixedly supporting and enclosing the motor 184, and a section 188 connected to the casing 186.

The mass element 182 and the motor 184 are similar to the mass element 142 and the motor 144 of the weight unit 140 of FIG. 10, and thus are not described in detail. It should be only noted that the mass element 182 has an axis Z-Z' of rotation, and can rotate in a balanced state about the axis Z-Z'. In the illustrated embodiment, for example, when the speed of the mass element 182 is 4,000 rpm, the angular momentum thereof becomes 11 kg cm s, and when an angular velocity required for applying an input torque is 45 degrees/sec, a precessional output torque becomes 9 kg cm.

The casing 186 includes a tubular side wall 190 and a flat bottom wall 192 integrally joined to one end of the side wall 190 to close the one end. In the illustrated embodiment, the casing 186 has an elliptic cylindrical shape, but alternatively, the casing 186 may have a cylindrical or prismatic shape. The motor 184 is directly secured to the inner surface of the bottom wall 192. The casing 186 may also enclose a storage battery (not shown) as a power source of the motor 184, which can be charged from outside of the casing 186.

The other open end of the side wall 190 is closed by a flat base 194 of the section 188. The outer surface 194*a* of the base 194 extends perpendicular to the rotation axis Z-Z'. The section 188 also includes a pair of flexible strips 196 and a heel support 198, both fixedly mounted on the outer surface of the base 194. Thus, the section 188 can be used for fitting the weight unit 180 onto one foot of an operator. Alternatively, by removing the heel support 198, the weight unit 180 can be fitted onto any desired portion of an operator's body by using the flexible strips 196.

Further, the section 188 may be mounted on the outer surface of the bottom wall 192 or of the side wall 190. In the latter case, the outer surface 194*a* of the base 194 may extend perpendicular to an axis X-X' or Y-Y'. In this manner, it becomes possible to change the relationship between the vector of angular momentum of the mass element 182 and the vector of input torque applied by an operator to the mass element 182. It is also possible to change the direction of rotation of the motor 184 so as to vary the direction of the vector of angular momentum of the mass element 182.

Figure 17:
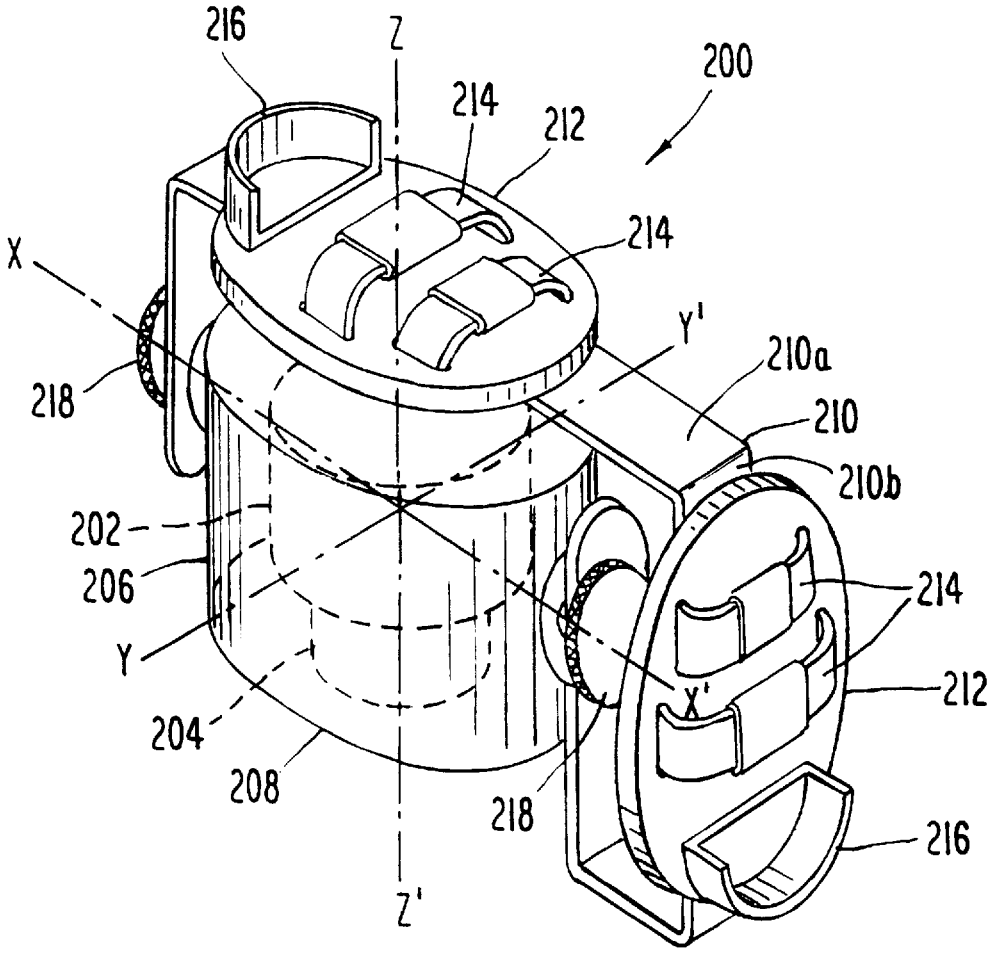
FIG. 17 is a left side parallel perspective view of an alternate embodiment of the present invention.

Referring to FIG. 17, a free weight unit 200 according to the present invention is shown for training or physically exercising the muscles of the human body, particularly for example, the muscles of the lower half of the human body, and more particularly a leg. The weight unit 200 includes a spinning mass element 202, an electric motor 204 for rotationally driving the mass element 202 about a rotation axis Z-Z', a casing 206 with a bottom lid 208 for accommodating the mass element 202 and the motor 204 therein, and shiftable member 210 pivotally connected to the casing 206. The casing 206 also accommodates a storage battery (not shown) for the motor 204, and the lid 208 is provided with a switch, an input voltage adjusting knob and an electrical terminal (not shown), in the same manner as the embodiment shown in FIGS. 10 to 15.

The shiftable member 210 has a bent plate configuration which includes an L-shaped portion integrally composed of two elongated sections 210*a* and 210*b*. The shiftable member 210 is connected to the casing 206 at the free ends thereof to be pivotable over 360 degrees around the casing 206 about a pivot axis X-X' which extends through the casing 206 and perpendicular to the rotation axis of the mass element 202. One section 210*a* of the shiftable member 210 extends along a first axis parallel to the pivot axis and the other section 210*b* extends along a second axis perpendicular to the first axis. Each section 210*a*, 210*b* is provided with a foot rest 212 in the shape of an oval flat plate fixed to the section 210*a*, 210*b*. The foot rest 212 is provided with a pair of flexible bands 214 for detachably fastening a foot of the leg to be trained on the foot rest 212. The foot rest 212 is also provided with a heel counter 216.

The shiftable member 210 is optionally clamped at a desired one of various angle positions around the casing 206 by loosening and tightening clamp knobs 218 provided on opposed ends of a pivot shaft (not shown) of the shiftable member 210. Therefore, the free weight unit 200 can obtain various vectors of the processional output torque by variously selecting the sections 210*a*, 210*b* of the shiftable member 210, and setting the desired one angle position of the shiftable member 210 around the casing 206, as well as selecting the input axis among the first, second and third axes, in the same manner as in the embodiment of FIGS. 10 to 15. The free weight unit 200 may be used for training the muscles of other limbs of a human body, such as an arm, by removing the heal counter 216 of the rest 212 to permit the weight unit 200 to be attached and fastened to a hand or forearm.

A person with ordinary skill in the art will easily conceive that, in any of the above-mentioned embodiments, an external power source may be connected to a suitable electrical terminal mounted on the casing to supply the electric motor with an electric power, instead of using the dry or storage batteries accommodated in the casing. In this case, an additional weight may be inserted into the space which is occupied by the batteries. It is possible to design the weight unit in such a manner that it can selectively use the electrical terminal and the batteries. Furthermore, it is possible to design the weight unit in such a manner that it includes a ball-shaped casing adapted to be grasped in one hand, which encloses a rotatable mass element, an electric motor and storage batteries, and thereby eliminating a grip member.

While the invention has been particularly shown and described with reference to preferred embodiments thereof, it will be understood by those skilled in the art that various changes and modifications may be made without departing from the spirit and scope of the invention. The scope of the invention is therefore to be determined by the following claims.

We claim:

1. A free weight unit with a spinning mass element for exercising muscles by utilizing a precessional output torque produced due to gyroscopic characteristics of said mass element, said precessional output torque acting as an additional load on the muscles together with a weight of said free weight unit, comprising:

a casing for accommodating said spinning mass element to permit said spinning mass element to rotate about a rotation axis in said casing;

an electric motor accommodated in said casing to rotationally drive said mass element about said rotation axis; a battery accommodated in said casing to supply an electric power for said electric motor;

a shiftable member connected to said casing to be pivotable over 360 degrees around said casing about a pivot axis extending through said casing and perpendicular to said rotation axis, said shiftable member including two elongated sections fixedly connected with each other, one section of which extends along a first axis parallel to said pivot axis and another section of which extends along a second axis perpendicular to said first axis; and connecting means for connecting said shiftable member to said casing, said connecting means permitting said shiftable member to pivot about said pivot axis over 360 degrees around said casing and to be optionally clamped at a desired one of various angle positions around said casing;

wherein a certain vector of said precessional output torque is generated due to an input torque applied to said spinning mass element rotating about said rotation axis by operating selected one of said two elongated sections of said shiftable member, clamped at said desired one of various angle positions around said casing, to turn about a certain input axis extending in a direction different from a direction of said rotation axis, said input axis being selected among said first axis, said second axis and a third axis perpendicular to both said first and second axes; and wherein various vectors of said precessional output torque are obtained by variously setting said selected one of said two elongated sections of said shiftable member, and said desired one of various angle positions of said shiftable member around said casing, as well as said certain input axis selected among said first, second and third axes.

2. The free weight unit of claim 1, wherein each of said two elongated sections of said shiftable member includes a grip suitable for being gripped by a hand.

3. The free weight unit of claim 1, wherein each of said two elongated sections of said shiftable member includes a rest suitable for being attached to a limb of a human body, said rest being provided with a flexible strip for fastening said selected one of said two elongated sections onto said limb.

4. The free weight unit of claim 1, wherein said shiftable member includes a generally L-shaped configuration in which said two elongated sections are integrally formed with each other, and a pair of connecting parts, each connecting part being fixed at one end thereof to a corresponding free end of said generally L-shaped configuration and pivotably connected at another end thereof to said casing.

5. The free weight unit of claim 1, wherein said connecting means includes a pair of shafts which extend on and along said pivot axis radially outward from said casing in an opposite direction, said shiftable member being pivotably mounted on said shafts, and a pair of clamp members provided respectively onto said shafts to optionally clamp said shiftable member on said shafts at said desired one of various angle positions of said shiftable member around said casing.

6. The free weight unit of claim 1, further comprising a switch for selectively opening and closing a power source circuit for said electric motor, said switch being provided on an outer wall surface of said casing.

7. The free weight unit of claim 1, wherein said electric motor rotationally drives said mass element at variable speed.

8. The free weight unit of claim 7, further comprising a knob for variably adjusting an input voltage from said battery to said electric motor, said knob being provided on an outer wall surface of said casing.

9. The free weight unit of claim 1, wherein said battery is a storage battery, and further comprising an electrical terminal used for charging said storage battery, said electrical terminal being provided on an outer wall surface of said casing.

* * * * *

UNITED STATES PATENT AND TRADEMARK OFFICE

CERTIFICATE OF CORRECTION

PATENT NO. : 5,807,215

DATED : September 15, 1998

INVENTOR(S) : Takeshi Abe and Toshiharu Kumazawa

It is certified that error appears in the above-identified patent and that said Letters Patent is hereby corrected as shown below:

On the title page, item[54] and

Column 1, Line 1, the title of the invention "Weight Unit With Rotatable Mass" should be --Free Weight Unit With Spinning Mass Having Shiftable Handle--.

Signed and Sealed this

Ninth Day of March, 1999

*Attest:*

*Attesting Officer*

Q. TODD DICKINSON

*Acting Commissioner of Patents and Trademarks*